US008038237B2

(12) United States Patent
Muhl

(10) Patent No.: US 8,038,237 B2
(45) **Date of Patent: *Oct. 18, 2011**

(54) TRANSPORT APPARATUS FOR FLAT MATERIALS TO BE PRINTED

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 350 days.

This patent is subject to a terminal disclaimer.

(21) Appl. No.: 12/335,674

(22) Filed: Dec. 16, 2008

(65) Prior Publication Data

US 2009/0152807 A1 Jun. 18, 2009

(30) Foreign Application Priority Data

Dec. 17, 2007 (DE) ..... 10 2007 060 787

(51) Int. Cl.
*B41J 3/00* (2006.01)

(52) U.S. Cl. ..... 347/4; 347/104; 271/1

(58) Field of Classification Search ..... None
See application file for complete search history.

(56) References Cited

U.S. PATENT DOCUMENTS

| | | | |
|---|---|---|---|
| 4,746,234 | A | 5/1988 | Harry |
| 4,903,954 | A | 2/1990 | Robertson et al. |
| 5,467,709 | A | 11/1995 | Salomon |
| 5,813,326 | A | 9/1998 | Salomon |
| 5,880,747 | A | 3/1999 | Bartenwerfer et al. |
| 5,883,643 | A | 3/1999 | Mok et al. |
| 5,949,444 | A | 9/1999 | Geserich et al. |
| 6,431,778 | B1 | 8/2002 | Coudray et al. |
| 6,467,901 | B2 | 10/2002 | Von Inten |
| 6,550,994 | B2 | 4/2003 | Manduley |
| 6,585,433 | B2 | 7/2003 | Davies et al. |
| 6,776,089 | B2 | 8/2004 | Kanda |

FOREIGN PATENT DOCUMENTS

| | | | |
|---|---|---|---|
| DE | 233 101 | B5 | 10/1995 |
| DE | 196 05 014 | C1 | 3/1997 |
| DE | 196 05 015 | C1 | 3/1997 |
| EP | 0 759 003 | B1 | 2/1997 |
| EP | 1 079 975 | B1 | 3/2001 |
| EP | 1 170 141 | B1 | 1/2002 |
| JP | 7-314821 | A | 12/1995 |
| JP | 8-318651 | A | 12/1996 |
| WO | 99/44174 | A1 | 9/1999 |

*Primary Examiner* — Matthew Luu
*Assistant Examiner* — Justin Seo
(74) *Attorney, Agent, or Firm* — Laurence A. Greenberg; Werner H. Stemer; Ralph E. Locher

(57) ABSTRACT

A transport apparatus for flat materials to be printed is used in a printing apparatus having a printing module. The transport apparatus is disposed in the printing apparatus in a stationary manner relative to a pressing apparatus which presses an item of mail onto the transport belt that acts on a part of a surface of the item of mail with a predefined adhesion friction in the transport region. That part of the surface of the item of mail is not printed but lies close to a region which is to be printed. Two deflection rollers and a supporting plate are provided for the transport belt, in order to form the transport region. The printing module protrudes at least partially into an intermediate space between the two deflection rollers. The printing module has at least one ink cartridge with an inkjet print head which is situated outside the transport region.

3 Claims, 2 Drawing Sheets

TRANSPORT APPARATUS FOR FLAT MATERIALS TO BE PRINTED

CROSS-REFERENCE TO RELATED APPLICATION

Figure 1:
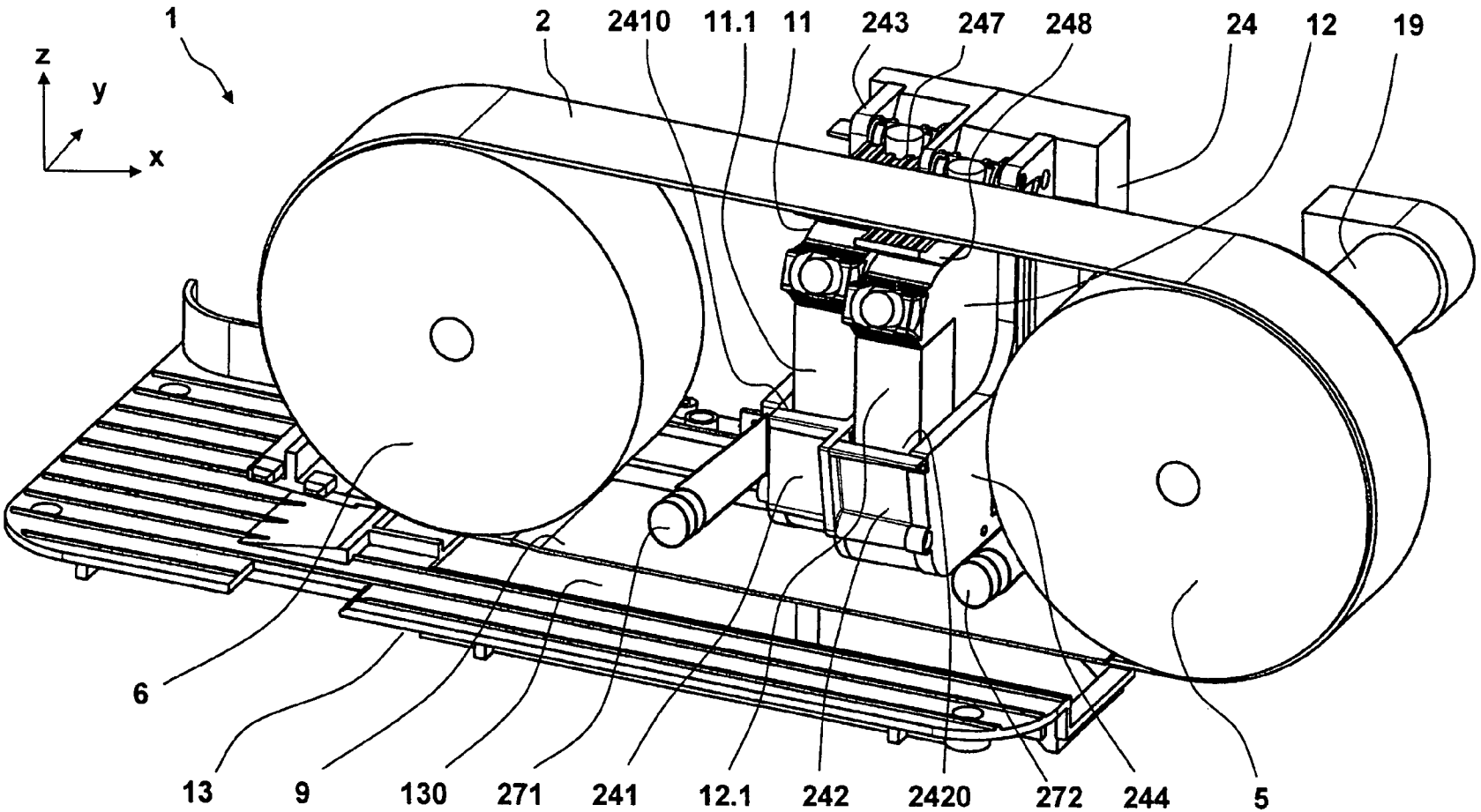

This application claims the priority, under 35 U.S.C. §119, of German Patent Application DE 10 2007 060 787.5, filed Dec. 17, 2007; the prior application is herewith incorporated by reference in its entirety.

BACKGROUND OF THE INVENTION

Field of the Invention

The invention relates to a transport apparatus for flat materials to be printed. The transport apparatus is used in a printing apparatus having a printing module. The transport apparatus is disposed in the printing apparatus in a stationary manner with respect to a pressing apparatus which presses the item of mail onto the transport belt that acts on a part of the surface of the item of mail with a predefined adhesion friction in a transport region. That part of the surface of the item of mail is not printed, but lies close to a region which is to be printed. The invention is used in microprocessor-controlled printing apparatuses and is suitable for franking machines and other mail processing units. The invention makes it possible to achieve a low offset of dots during printing which improves, in particular, a machine-readability of an imprint of a franked item of mail.

An apparatus which employs a transport principle and has a belt that lies at the top and a sprung back pressure apparatus that lies underneath, between which an item of mail is clamped, is known from East German Patent Application DD 233 101 B5, corresponding to U.S. Pat. No. 4,746,234. However, a thermal transfer ink ribbon which is used is unsuitable as a transport belt. The thermal transfer ink ribbon is disposed above a feed table, over which the items of mail are transported in a lying manner downstream in the direction of the mail flow. The feed table has openings, through which a driven back pressure roller engages on the item of mail.

U.S. Pat. No. 6,550,994 has disclosed a franking machine having a transport apparatus for items of mail, by way of which transport apparatus the letters are transported through the franking machine through the use of a transport belt which lies at the top and a plurality of sprung levers which are disposed underneath. Similar subject matter is also apparent from U.S. Pat. No. 5,813,326, U.S. Pat. No. 6,776,089 and U.S. Pat. No. 6,585,433. The transport belt is mounted in the manner of a loop on rollers and does not allow the printing module or a part thereof to protrude into the region between the rollers. The width of the transport belt is relatively small and corresponds to approximately 1 inch. The extent of the housing transversely with respect to the transport direction of the items of mail is relatively great in comparison. An additional factor is that a second printing position is provided for printing franking strips which are rolled up on reels and which are unrolled for printing. That second printing path causes higher production costs.

U.S. Pat. No. 5,467,709 has already disclosed a printing apparatus for an inkjet franking machine, in which a franking imprint is printed onto an item of mail through the use of an inkjet print head during approximately horizontal letter transport. The inkjet print head is disposed in a stationary manner behind a guide plate in a recess for printing. A circulating transport belt, which is likewise disposed on the side of the guide plate, serves as a transport apparatus. A supporting and pressing apparatus having a plurality of rollers is disposed on the other side opposite the guide plate, with the result that an item of mail which is fed in is clamped between the rollers of the supporting and pressing apparatus and the circulating transport belt. However, the apparatus cannot avoid oblique running of the printing media. An insufficiently tensioned transport belt or a not exactly parallel alignment of the axles of those rollers, on which the transport belt circulates, is sufficient to involve the above-mentioned risk. The supporting and pressing apparatus is very complicated as a result of the multiplicity of rollers of that apparatus.

German Patent DE 196 05 015 C1, corresponding to U.S. Pat. No. 5,949,444, has already proposed an embodiment of a printing apparatus of an inkjet franking machine which is the JetMail® apparatus of the applicant of the instant application, Francotyp-Postalia AG & Co. That embodiment carries out a franking imprint during non-horizontal, approximately vertical letter transport through the use of an inkjet print head which is disposed in a stationary manner behind a guide plate in a recess. A circulating transport belt having pressing elements for the items of mail (letters up to 20 mm thickness, DIN (German Standard) B4 format) or for franking strips, which are configured in such a way that they can be adhesively bonded to packages of any desired thickness, serves as a transport apparatus. The printing medium (letter, package, franking strip) is clamped between the pressing elements and the guide plate.

Transport and drive apparatuses of relatively simple construction without a back pressure apparatus (see German Patent DE 196 05 014 C1) or with a back pressure apparatus (see International Publication No. WO 99/44174) in the vicinity of the printing region using at least one inkjet print head, have also already been proposed. In International Publication No. WO 99/44174, the latter is disposed downstream of an intake roller pair in the transport direction of the mail flow, with the upper roller being driven and the lower back pressure roller being sprung. A further roller pair downstream of the inkjet print head in the mail flow direction close to an ejection device likewise exerts a force on the printing medium. The printing region is spaced apart from the force transmission region of one of the roller pairs by more than one radius of the respectively driven roller. Although the printing information can in principle be changed in all regions by digital printing, the print quality becomes lower as a higher transport speed is selected. In particular, during the use of two inkjet print heads, an offset in the printed image (butting or connection error) can occur along a printed length in the transport direction. The offset makes evaluation of the printed image by machine difficult. The action of the force of the further roller pair downstream of the inkjet print head in the direction of the mail flow close to the ejection device leads to different distances being covered and therefore to the butting or connection error in the printed image in the case of two inkjet print heads which are offset with respect to one another. The print quality which is required in the context of current programs of mail deliverers (for example, the Information Based Indicia Program of the USPS) would therefore only be possible to achieve at a low printing speed. The low thickness of the printing media which can be printed by a printing apparatus that is constructed simply in that way is also disadvantageous.

European Patent EP 1 079 975 B1, corresponding to U.S. Pat. No. 6,431,778, has disclosed an apparatus for printing characters on a predefined location of one side of a flat recording medium, and has also disclosed a franking machine which is equipped correspondingly. A transport belt is disposed firstly on the inkjet print head side and secondly forms an unsuspended supporting device for that side of a flat recording medium (object, item of mail, envelope) which is to be printed. A back pressure apparatus supports the flat object from below. In that back pressure apparatus, a belt rolls around at least two other rollers, at least one of which is not suspended.

An apparatus which is known from European Patent EP 1 170 141 B1, corresponding to U.S. Pat. No. 6,467,901, for printing a printing medium in the printing region, uses a driven transport drum and nondriven back pressure rollers in the force transmission region or, as an alternative, a nondriven back pressure conveyor belt. In the printing region, a stationary inkjet print head prints the printing medium which is moved downstream, with the inkjet print head being disposed axially with respect to the transport drum. The printing region is preferably approximately 1 inch and is spaced apart from the force transmission region, with the spacing of the most remote pixel from the edge of the transport drum being smaller than the radius of the circumference of the transport drum. However, the slight approximately linear contact of that surface of the item of mail which is to be printed with the transport drum and an intake wheel for items of mail which is disposed at a spacing are disadvantageous. The intake wheel is driven by the transport drum through a toothed belt. This causes a $\Delta x$ offset of the dots in the printed image. A $\Delta y$ offset of the dots in the printed image results orthogonally with respect thereto, in particular in the case of items of mail having a very large format. Moreover, the construction causes high production costs.

In the market segment of franking machines having small to medium mail item throughputs, a compact transport apparatus for items of mail is required, with production costs which are as low as possible.

SUMMARY OF THE INVENTION

It is accordingly an object of the invention to provide a transport apparatus of a printing apparatus for flat materials to be printed, which overcomes the hereinafore-mentioned disadvantages of the heretofore-known devices of this general type and which ensures a high print quality in the case of a medium throughput of flat materials, during interaction with a microprocessor-controlled printing apparatus.

Despite low production costs, the reliability of the printing apparatus is to be as high as possible and the printing offset in the x-direction and y-direction should be low. In this case, firstly postcards and secondly C4 and B4 sized letters having a mail item thickness of up to 10 mm are to be processed.

With the foregoing and other objects in view there is provided, in accordance with the invention, in a printing apparatus having a printing module, a pressing apparatus and a transport belt acting on a part of a surface of an item of mail with a predefined adhesion friction in a transport region, the part of the surface of the item of mail not being printed but lying close to a region to be printed, a transport apparatus for flat materials to be printed. The transport apparatus is disposed in a stationary manner in the printing apparatus relative to the pressing apparatus which presses the item of mail onto the transport belt. The transport apparatus comprises two deflection rollers and a supporting plate associated with the transport belt to form the transport region. The two deflection rollers define an intermediate space therebetween into which the printing module at least partially protrudes. At least one ink cartridge of the printing module has an inkjet print head disposed outside the transport region.

A printing position is reached by a transverse movement of a printing module transversely with respect to the transport direction of the items of mail through the use of a transverse movement device. During printing according to an inkjet printing process, the printing module is held in the printing position and a transport apparatus is disposed correspondingly, in order to transport flat materials or an item of mail horizontally past the print head. The transport apparatus is disposed in the printing apparatus in a stationary manner with respect to a pressing apparatus, which presses the item of mail onto the transport belt.

In the transport region, the transport belt acts with a predefined adhesion friction on a part of the surface of the item of mail. That part is not printed but lies close to the region which is to be printed.

A printing module is disposed above a printing window in the z-direction of a Cartesian coordinate system counter to the direction of the force of gravity. During printing, a printed image is printed by at least one print head. For example, at least one print head of an ink cartridge ejects ink droplets through the printing window in the direction of the force of gravity, counter to the z-direction. The printing window is disposed at the edge of a transport belt in a housing part. The transport belt transports a flat material which is to be printed at the edge past the at least one print head in the transport direction x during printing. The flat materials are pressed onto the transport belt in a supporting region, counter to the force of gravity.

It has been shown empirically that a supporting region advantageously stretches over both sides of a line which extends centrally through the printing window transversely with respect to the transport direction x in the y-direction of the Cartesian coordinate system. The transport belt is supported on a supporting plate which is disposed above the transport region between a shaped partial plate and a bearing plate of a roller carrier. A supporting surface area of the supporting plate is greater than a surface area of the printing window adjacent the supporting plate.

The printing apparatus is disposed in a box-shaped chassis. The box-shaped construction ensures high stability with a very simple construction. By enlarging the deflection rollers of the transport apparatus, the printing module can then protrude into the region between the rollers. By way of this and due to the use of a flat belt as the transport belt, the guidance is improved during transport of the items of mail and the printing offset in the x-direction and y-direction is less than 100 μm in both directions. As a result of the protrusion of the printing module or parts thereof and as a result of the omission of a second printing path, the extent of the chassis and the housing has been reduced in the y-direction, that is to say transversely with respect to the transport direction of the items of mail.

The transport apparatus for flat materials which are to be printed has a printing module in the printing position, from which the printing module can be moved transversely with respect to the transport direction of the items of mail in a manner known per se into a cleaning and sealing position by transverse movement devices which are known per se. The cleaning and sealing position can advantageously be disposed more closely to the transport belt. As a result, the extent of the chassis and the housing has likewise been reduced transversely with respect to the transport direction of the items of mail.

The transport belt is preferably a driven wide tensioned flat belt. The latter is guided along both over the printing module and under the printing module through the use of deflection rollers, while the printing module is situated in a printing position. In the printing position, the printing module protrudes at least partially into the intermediate space between the two deflection rollers, with the heads of the two ink cartridges continuing to be situated outside the transport region, however.

Other features which are considered as characteristic for the invention are set forth in the appended claims.

Although the invention is illustrated and described herein as embodied in a transport apparatus for flat materials to be printed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE VIEW OF THE DRAWING

Figure 2:
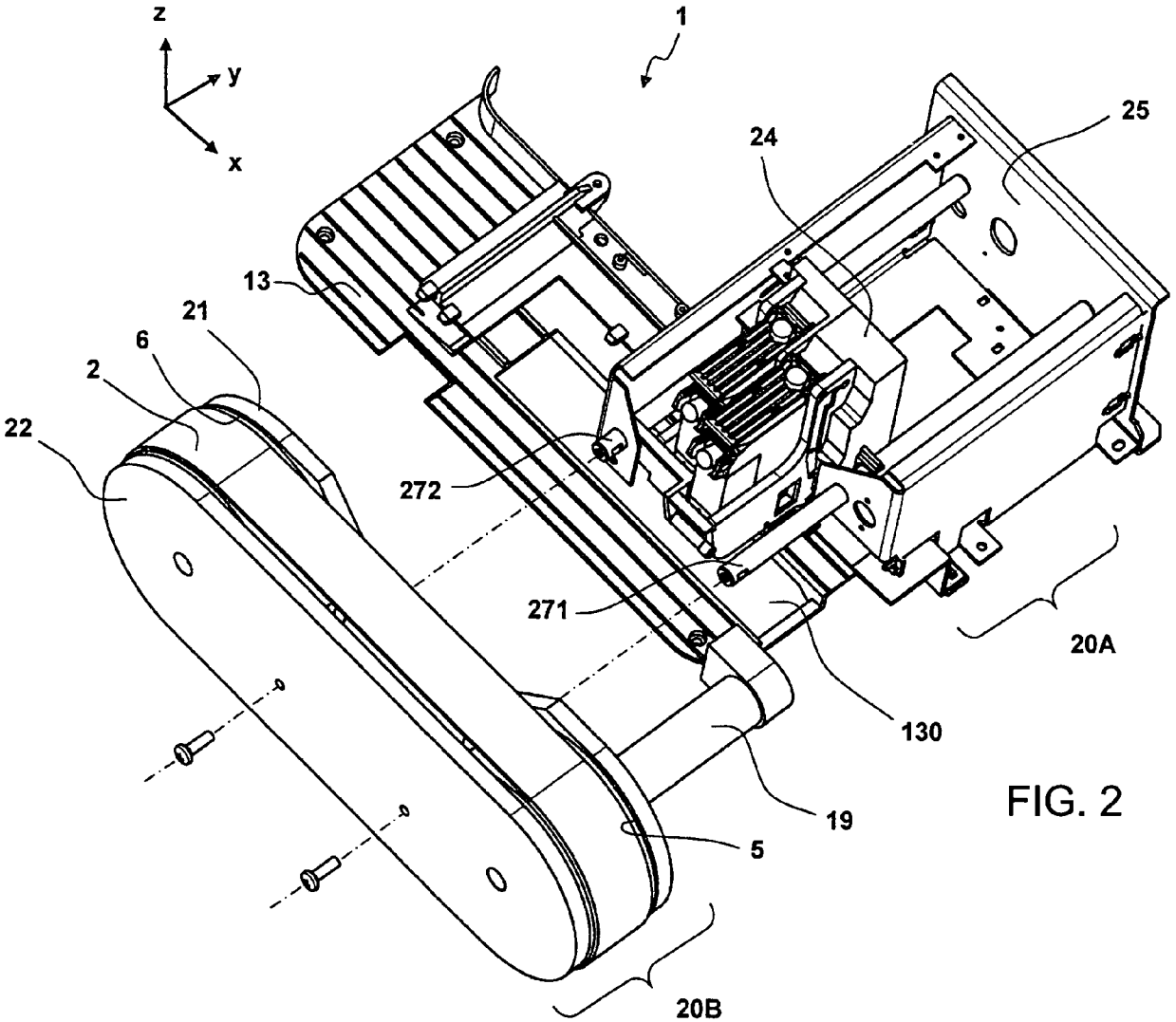

FIG. 1 is a perspective view of a transport apparatus for flat materials having a printing module in a printing position; and FIG. 2 is an exploded, perspective view of the transport apparatus.

DETAILED DESCRIPTION OF THE INVENTION

Referring now in detail to the single figure of the drawing, there is seen a perspective view of a transport apparatus 1 for flat materials or items of mail having a printing module in a printing position. The transport apparatus 1 is a substantial constituent part or component of a franking machine and is disposed above a feed table 13. A non-illustrated pressing apparatus, which applies back pressure from below in a sprung or resilient manner, is disposed below the feed table 13 and acts in a z-direction through an opening 130 formed in the feed table 13.

As is known, a franking machine includes, inter alia, an electronic part (a non-illustrated meter) and the mail item transport apparatus having a non-illustrated electronic controller. A keyboard and a display unit of the meter are connected to the electronic part in a manner which is not shown. The electronic controller is connected electrically to a drive 19 of the mail item transport apparatus 1 in order to actuate it. An electric motor having a gear mechanism is used, for example, as the drive 19. The transport apparatus 1 has a transport belt 2 which is configured as a flat belt.

In a transport region, the flat belt acts with a predefined adhesion friction on a part of the surface of the flat materials or items of mail. That part of the surface is not printed but is close to the printing region.

The flat belt of the mail item transport apparatus has a high transverse rigidity and is guided over two deflection rollers 5 and 6. In this case, the flat belt firstly runs under the printing module and secondly is guided back above the printing module. As is known, the printing module includes a printing carriage 24, non-illustrated contact and actuating electronics on the rear side of the printing carriage 24, and at least one print head, for example an ink cartridge with an integrated inkjet print head. The printing carriage 24 of the printing module is configured so as to slide on two sliding rods 271, 272 which are fastened on the rear side to a rear wall of a box-shaped chassis and on the front side to a bearing plate of a roller carrier for the deflection rollers. In the illustrated example shown in the figure, the printing carriage 24 preferably carries two ink cartridges 11, 12 which are offset with respect to one another in the x-direction and y-direction. As an alternative, a multiplicity of ink cartridges is also possible. The printing carriage 24 has in each case one opening 2410, 2420 for inserting the ink cartridges 11, 12. The opening 2410, 2420 is delimited laterally by a right-hand side plate 244 and a left-hand side plate 243, on the base side by a carrier-shaped part and on the rear side by a contact field of the contact and actuating electronics. The carrier-shaped part includes two halves, that is a first half 241 being equipped with the first opening 2410 for inserting the first ink cartridge 11, and a second half 242 being equipped with the second opening 2420 for inserting the second ink cartridge 12 and being offset in the x-direction with respect to the first half. The first carrier-shaped part half 241 is offset in the y-direction with respect to the second half. Each opening is closed at the top by one respective closure lever 247, 248 per cartridge. In the printing position, the printing module protrudes into an intermediate space between the deflection rollers 5 and 6, with the inkjet print heads of the two ink cartridges 11, 12 being situated outside the transport region and being disposed above a non-illustrated printing window in the z-direction of a Cartesian coordinate system counter to the direction of the force of gravity. Undersides 11.1, 12.1 of the two ink cartridges 11, 12 are situated within the intermediate space between the deflection rollers 5 and 6 above a supporting plate 9.

FIG. 2 is an exploded, perspective view of the transport apparatus. Provision is made for the transport belt 2 to be supported on the supporting plate, which is disposed above the transport region between a shaped partial plate 21 and a bearing plate 22 of a roller carrier 20B. In this case, a supporting surface of the supporting plate is larger than a surface area of a non-illustrated printing window opposite the at least one ink jet print head. The printing window is disposed adjacent the supporting plate in a tabletop of the feed table 13 in a y-direction offset from the opening 130, through which a pressing apparatus disposed below the feed table protrudes, exerting counter-pressure from below in a resilient or springy fashion. Furthermore, it is provided that the printing carriage 24 of the printing module is equipped accordingly to glide on two sliding rods 271, 272 which are mounted at a rear end on a rear wall 25 of a box-shaped chassis 20A and, at a front end, at the bearing plate 22 of a roller carrier 20B for the deflection rollers, in which case the roller carrier 20B with the deflection rollers 5 and 6 as well as with the transport belt 2 is a constituent part of the transport apparatus 1 that can be removed from the chassis 20A and can be exchanged. The drive 19, for example an electromotor having a transmission, is attached at the roller carrier 20B and, with regard to the drive, has a direct effect on the shaft of the deflection roller 5.

Alternatively, the drive 19 can be attached to the box-shaped chassis 20A in a non-illustrated manner. The shaft of the drive 19 and the shaft of the deflection roller 5 are then constructed to be able to be coupled to one another through a coupling device.

The invention is not restricted to the present embodiment. Rather, a number of units are conceivable in the context of the claims. These units are used and are included in the scope of the present claims in a manner which proceeds from the basic concept of the invention.

The invention claimed is:

1. In a printing apparatus having a printing module, a pressing apparatus and a transport belt acting on a part of a surface of an item of mail with a predefined adhesion friction in a transport region, the part of the surface of the item of mail not being printed, a transport apparatus for flat materials to be printed, the transport apparatus disposed stationary in the printing apparatus relative to the pressing apparatus pressing the item of mail onto the transport belt, the transport apparatus comprising:

two deflection rollers and a supporting plate associated with the transport belt to form the transport region;

said two deflection rollers defining an intermediate space therebetween into which the printing module at least partially protrudes;

the transport belt being a driven wide tensioned flat belt, guided along over the printing module and under the printing module by said two deflection rollers, while the printing module is situated in a printing position; and at least one ink cartridge of the printing module having an inkjet print head disposed outside the transport region.

2. In a printing apparatus having a printing module, a pressing apparatus and a transport belt acting on a part of a surface of an item of mail with a predefined adhesion friction in a transport region, the part of the surface of the item of mail not being printed, a transport apparatus for flat materials to be printed, the transport apparatus disposed stationary in the printing apparatus relative to the pressing apparatus pressing the item of mail onto the transport belt, the transport apparatus comprising:

two deflection rollers and a supporting plate associated with the transport belt to form the transport region;

said two deflection rollers defining an intermediate space therebetween into which the printing module at least partially protrudes;

at least one ink cartridge of the printing module having an inkjet print head disposed outside the transport region; and a roller carrier having a shaped partial plate and a bearing plate.

said supporting plate being disposed above the transport region between said shaped partial plate and said bearing plate, the transport belt being supported on said supporting plate, and said supporting plate having a supporting surface with an area being greater than a surface area of a printing window adjacent said supporting plate and opposite at least one ink jet print head of the printing module.

3. In a printing apparatus having a printing module, a pressing apparatus and a transport belt acting on a part of a surface of an item of mail with a predefined adhesion friction in a transport region, the part of the surface of the item of mail not being printed, a transport apparatus for flat materials to be printed, the transport apparatus disposed stationary in the printing apparatus relative to the pressing apparatus pressing the item of mail onto the transport belt, the transport apparatus comprising:

two deflection rollers and a supporting plate associated with the transport belt to form the transport region;

said two deflection rollers defining an intermediate space therebetween into which the printing module at least partially protrudes;

at least one ink cartridge of the printing module having an inkjet print head disposed outside the transport region;

a box-shaped chassis having a rear wall;

a roller carrier for said deflection rollers, said roller carrier having a bearing plate;

two sliding rods having a rear end mounted at said rear wall of said chassis and a front end mounted at said bearing plate; and a printing carriage of the printing module configured to slide on said sliding rods;

said roller carrier with said deflection rollers and with the transport belt being a constituent part of the transport apparatus to be removed from said chassis and exchanged.

* * * * *